US006968803B1

(12) United States Patent
Wekstein

(10) Patent No.: US 6,968,803 B1
(45) Date of Patent: Nov. 29, 2005

(54) CHART HOLDER WITH PRIORITY SCHEDULER AND METHOD OF USE

(76) Inventor: Ted Wekstein, 48 Horseshoe Hill Rd., Pound Ridge, NY (US) 10576

( * ) Notice: Subject to any disclaimer, the term of this patent is extended or adjusted under 35 U.S.C. 154(b) by 0 days.

(21) Appl. No.: 10/379,251

(22) Filed: Mar. 4, 2003

(51) Int. Cl.[7] ..... G09F 19/00

(52) U.S. Cl. ..... 116/201; 116/307; 116/DIG. 1; 40/491; D19/90

(58) Field of Search ..... 206/425, 459.1; 53/473, 507; 40/312, 491, 489; 116/1, 306, 116/307, 308, 313, 316, 318, 323, 324, 334, 116/DIG. 1; D19/90, 91

(56) References Cited

U.S. PATENT DOCUMENTS

| | | | | | |
|---|---|---|---|---|---|
| 146,623 | A | * | 1/1874 | Wadsworth | 116/324 |
| 1,602,833 | A | * | 10/1926 | Perry | 232/5 |
| 2,324,934 | A | | 7/1943 | June | 116/307 |
| 2,587,989 | A | * | 3/1952 | Hans | 116/308 |
| 2,731,941 | A | | 1/1956 | Anderson | 116/324 |
| 2,838,862 | A | | 6/1958 | McConnell | 40/114 |
| 2,877,736 | A | * | 3/1959 | Simmons | 116/323 |
| D191,022 | S | | 8/1961 | MacKrell | D19/90 |
| 3,294,422 | A | * | 12/1966 | Dragoljub | 40/359 |
| 3,295,241 | A | * | 1/1967 | Chiuminatto | 40/490 |
| 3,304,907 | A | | 2/1967 | Block | 116/315 |
| 3,397,434 | A | | 8/1968 | Arblaster | 40/5 |
| 3,491,715 | A | * | 1/1970 | Longarini | 116/307 |
| 3,903,837 | A | * | 9/1975 | Barton et al. | 116/315 |
| 4,014,285 | A | * | 3/1977 | Davis | 116/307 |
| 4,041,893 | A | | 8/1977 | Mulloy | 116/308 |
| 4,582,018 | A | | 4/1986 | Fleck et al. | 116/321 |
| 4,811,845 | A | * | 3/1989 | Baggett | 206/534 |
| 4,885,857 | A | * | 12/1989 | Leflet | 40/533 |
| 4,905,388 | A | * | 3/1990 | Sinkow | 40/110 |
| D310,107 | S | * | 8/1990 | Murphy et al. | D19/90 |
| D390,268 | S | * | 2/1998 | Stravitz | D19/90 |
| D390,271 | S | | 2/1998 | Wolff | D19/90 |
| D391,990 | S | | 3/1998 | Wolff | D19/78 |
| 5,813,539 | A | * | 9/1998 | DePalma | 206/459.1 |
| 5,833,066 | A | * | 11/1998 | Hargus et al. | 206/438 |
| 6,036,490 | A | | 3/2000 | Johnsen et al. | 433/102 |
| 6,050,214 | A | * | 4/2000 | OKeefe | 116/323 |
| 6,092,672 | A | | 7/2000 | Harris et al. | 211/11 |
| D459,398 | S | * | 6/2002 | Stravitz | D19/90 |
| 2003/0213151 | A1 | * | 11/2003 | Gemma | 40/491 |

* cited by examiner

*Primary Examiner*—R Alexander Smith
(74) *Attorney, Agent, or Firm*—DeLio & Peterson, LLC; Peter W. Peterson

(57) ABSTRACT

A record holder and scheduler comprises a file container of sufficient size to hold a tangible record of a person or thing, the file container having front and rear faces. On the file container there is disposed a schedule indicator and/or a condition indicator. The schedule indicator is positionable between different time markings to indicate visibly a time associated with the person or thing, and the condition indicator is positionable between different indicia to indicate visibly a status of the person or thing. The present invention is further directed to a method for using the record holder and scheduler.

3 Claims, 4 Drawing Sheets

CHART HOLDER WITH PRIORITY SCHEDULER AND METHOD OF USE

BACKGROUND OF THE INVENTION

1. Field of the Invention

The present invention relates to a record holder and scheduler and, in particular, to a holder and scheduler which may be utilized in the medical profession to secure medical records and indicate time and/or status of a patient's visit.

2. Description of Related Art

Medical professionals need to have access to a patient's medical records during office visits and hospital stays. Numerous record and chart holders have been employed for securing the patient's records so that they are available to the physician or other professional during such visits and stays. Typically, the patient's file is clipped to a chart holder which may be attached to a patient's bed or a wall in the room in which the patient is staying or being examined. Examples of such prior art chart holders are found in U.S. Pat. Nos. DES390271, 3,397,434, 2,731,941 and 3,304,907. Other file holders have also been employed for other purposes such as those in U.S. Patent Nos. DES391990 and 6,092,672.

Maintaining proper schedule of treatment of the patient during an office visit or hospital stay is desirable both to the patient and medical profession. Examples of indicators for signaling to medical personnel treatment to be undergone by patient and/or time of a particular procedure are disclosed in U.S. Pat. Nos. 4,041,893, and 4,582,018.

Notwithstanding these prior art devices, there is no currently adequate system for providing to the medical professional both the patient's records and the indicated status of a patient's visit or treatment, as well as the time for such a treatment. Furthermore, there exists no adequate combination of such functions which may be easily and visibly positioned in association with the patient's visit or stay, and yet is accessible to the medical professional for viewing of the patient's records and resetting of times and patient status.

SUMMARY OF THE INVENTION

Bearing in mind the problems and deficiencies of the prior art, it is therefore an object of the present invention to provide an improved record holder and scheduler for patients during medical visits and stays.

It is another object of the present invention to provide a patient record holder and scheduler which is readily visible to the medical professional.

A further object of the invention is to provide a patient's record holder and scheduler which is readily accessible for the patient's records and to change the patient's status and/or treatment time.

The above and other objects, which will be apparent to those skilled in art, are achieved in the present invention which is directed to a record holder and scheduler comprising a file container of sufficient size to hold a tangible record of a person or thing, the file container having front and rear faces. On the file container there is disposed a schedule indicator and/or a condition indicator. The schedule indicator is positionable between different time markings to indicate visibly a time associated with the person or thing, and the condition indicator is positionable between different indicia to indicate visibly a status of the person or thing.

Preferably, the file container holds the records loosely, and has an open top for inserting and removing the records. The preferred embodiment also has a base and is rigid, such that the file container is self supporting and positionable in an upright position on a horizontal surface. The record holder and scheduler may further include fasteners to removably attach the file container to a surface, such as a vertical wall.

The schedule indicator may include a series of time markings on the front face and an indicator linearly slidable along the front panel to different positions adjacent the time markings, a dial indicator rotatable to different positions adjacent the time markings, or other means for indicating the time markings.

The condition indicator may include a plurality of status indicia markings on the front face and a panel movable to reveal different ones of the status indicia markings. The panel may be hinged to the front face and may be flipped to conceal and reveal different ones of the status indicia markings. The condition indicator may also comprise a plurality of status indicia markings on the front face and a dial indicator rotatable to different positions adjacent the status indicia markings, or other means for indicating the status indicia markings.

In another aspect, the present invention is directed to a method of securing records and indicating schedule and status of a person or thing associated with the records. The method first comprises providing a file container of sufficient size to hold a tangible record of a person or thing. The file container has front and rear faces, and includes a schedule indicator positionable between different time markings to indicate visibly a time associated with the person or thing, and/or a condition indicator positionable between different indicia to indicate visibly a status of the person or thing. The method then comprises placing a tangible record of a person or thing in the file container, adjusting the schedule indicator positionable to a time associated with the person or thing; adjusting the condition indicator to a current status of the person or thing, and moving the file container to a location associated with the person or thing to visibly indicate the time and status of the person or thing. The method may further include re-adjusting the condition indicator to change the current status of the person or thing, and/or re-adjusting the scheduling indicator to change the time associated with the person or thing. The method may also include removably attaching the file container to a vertical surface.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
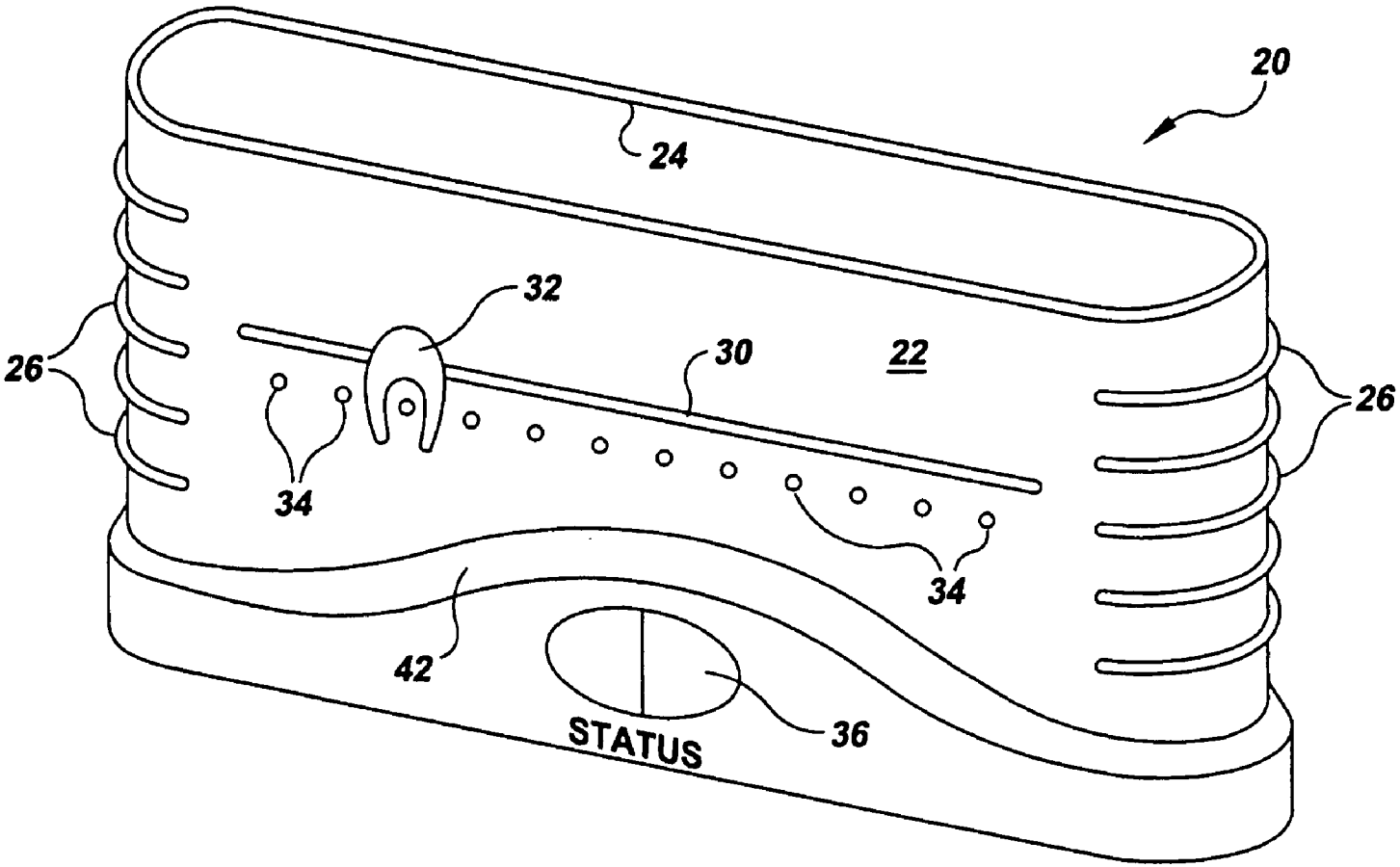
FIG. 1 is a perspective view showing the front, top and side of the preferred patient record holder and scheduler of the present invention.

In describing the preferred embodiment of the present invention, reference will be made herein to FIGS. 1–10 of the drawings in which like numerals refer to like features of the invention.

The preferred patient's record holder and scheduler of the present invention is depicted in various overall views in FIGS. 1–7. Although it is described in connection with medical records for a patient, it may be employed to hold any type of record for, and to schedule and indicate status or condition of, any office or industrial use generally related to any person or thing, such as an individual, article or process. The invention may be used for documents, records and scheduling in other professional fields such as law, business, banking, real estate, and the like. The record holder and scheduler 20 has a body portion 22 which holds conventional charts, files, papers or other tangible records, preferably loosely for convenient access through an opening in the upper portion bounded by rim 24. Rim 24 is lower in the front than the back (FIG. 2), and any records or other papers in the well of the body are readily visible through the top opening. The body 22 may be made of any rigid or flexible material but is preferably made of a relatively hard plastic for durability. Typically, the record holder and scheduler has dimensions of about 14 inches in width, 8 inches in height, and 3 inches in thickness. Bottom portion 28 is preferably rigid so that the record holder and scheduler 20 can be self-supporting when placed on a horizontal surface such as a desk or tabletop.

To provide strengthening and/or decorative ornamentation, ribs 26 extend around the opposite side ends of body 22, to a portion of the front and back walls, and a beveled portion 42 extends along the front of the body. Additionally, ornamentation such as advertising may be placed on the front surface of the body 22.

Figure 10:
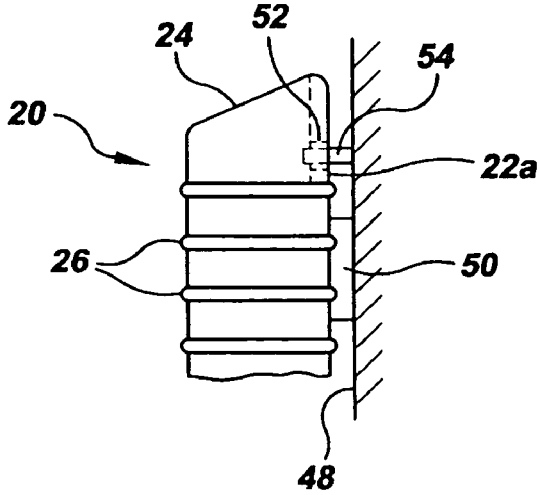
FIG. 10 is a side-elevational view of the top portion of the patient's record holder and scheduler of FIG. 1 removably mounted to a wall.

As shown in FIG. 10, the record holder and scheduler may be releasably secured and mounted to a vertical surface 48 such as a wall or bed footboard by a magnet or double sided adhesive tape 50 on the back wall 22*a* of the record holder. Alternatively, openings 52 in the upper portion of back wall 22*a* may receive a screw, hook or wall anchor 54 extending from the wall to removably secure the chart holder.

So that the medical professional accessing the patient's records in the record holder 20 may instantly know the priority of the scheduled time of the patient's visit and/or treatment, as well as the status of the patient, there are provided visual indicia of the same on the front or other visible panel of the record holder. As shown most clearly in FIGS. 1 and 2, a horizontal slot 30 extending substantially across the front of body 22 receives a slideable tab 32. Indicia 34 below and adjacent to the slot are printed, adhered to, or otherwise marked on the body surface to indicate the time of day. Tab 32 having a cut-out opening in its lower portion may be slidingly moved along slot 30 so that the opening registers with the indicated time associated with the patient's visit or treatment, or time for any scheduled event in general. This tab may be readjusted as necessary to change the time for a particular patient's visit or treatment, or for any other schedule relating to the person or thing's records in holder 20.

The patient's treatment status is indicated in status indicator 36 also preferably disposed on the front or other visible panel of the record holder and scheduler. As shown close up in FIG. 8 the preferred status indicator comprises a flap 38 secured by a hinge, e.g., a living or plastic hinge, and movable in the directions indicated by the arrows to alternately cover up and expose different status indicia such as "Wait" and "In Session". This status indicator may be used in general to indicate any type of procedure, classification or other condition for the person or thing to which the records relate.

Figure 2:
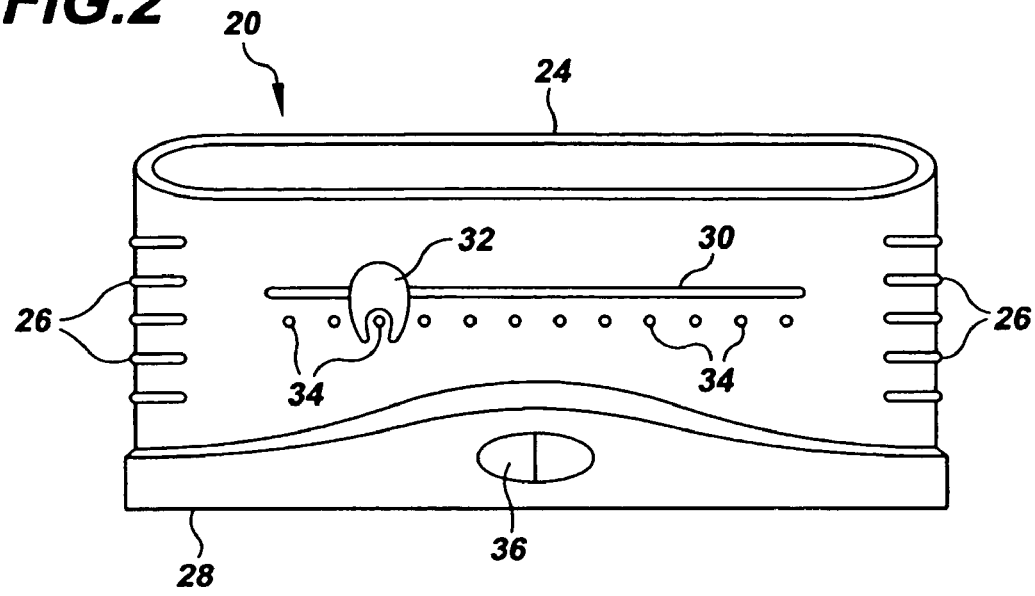
FIG. 2 is a front elevational view of the patient's record holder and scheduler of FIG. 1.
Figure 3:
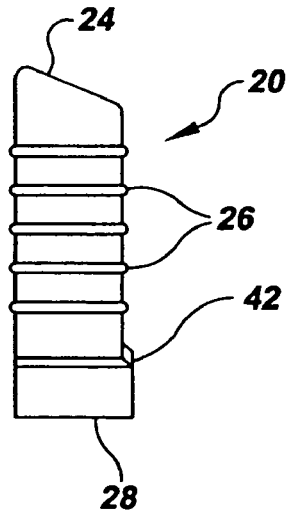
FIG. 3 is a side elevational view of the patient's record holder and scheduler of FIG. 1.
Figure 4:
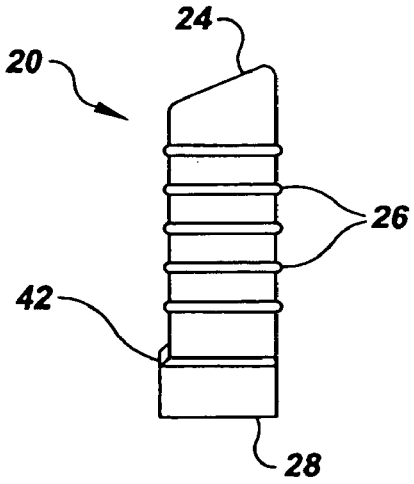
FIG. 4 is an opposite side elevational view of the patient's record holder and scheduler of FIG. 1.
Figure 5:
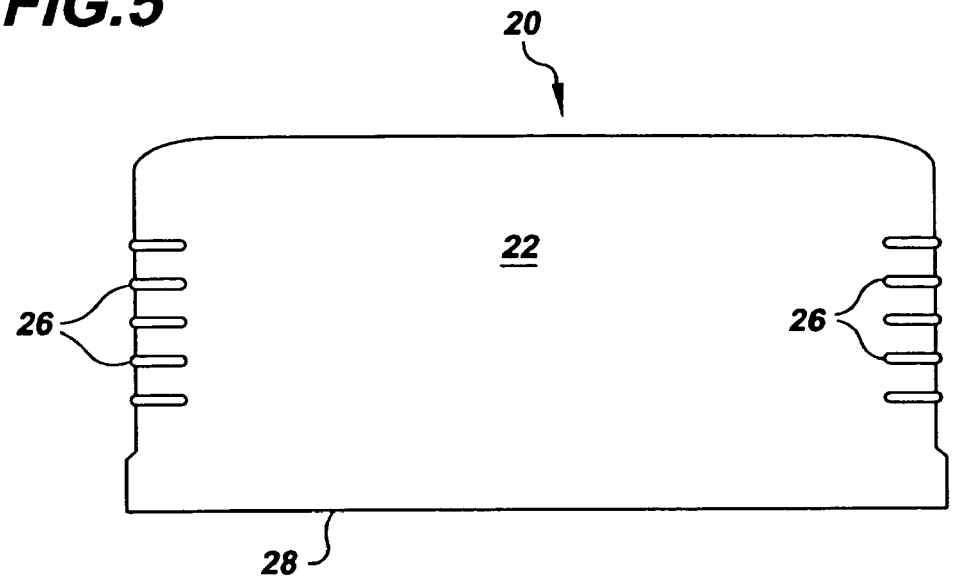
FIG. 5 is a rear elevational view of the patient's record holder and scheduler of FIG. 1.
Figure 6:
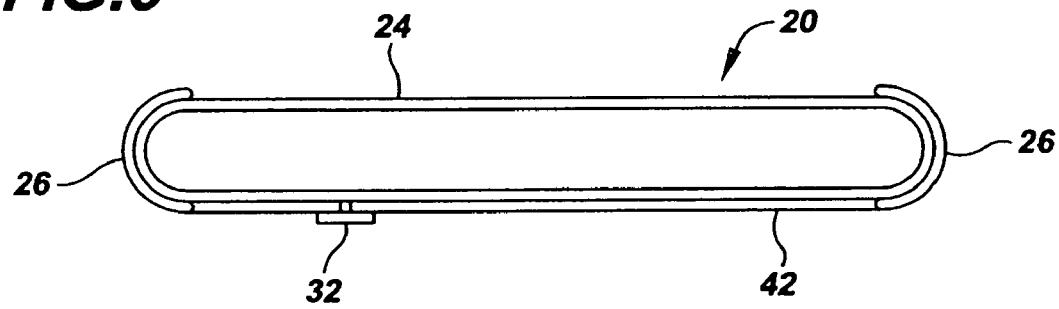
FIG. 6 is a top plan view of the patient's record holder and scheduler of FIG. 1.
Figure 7:
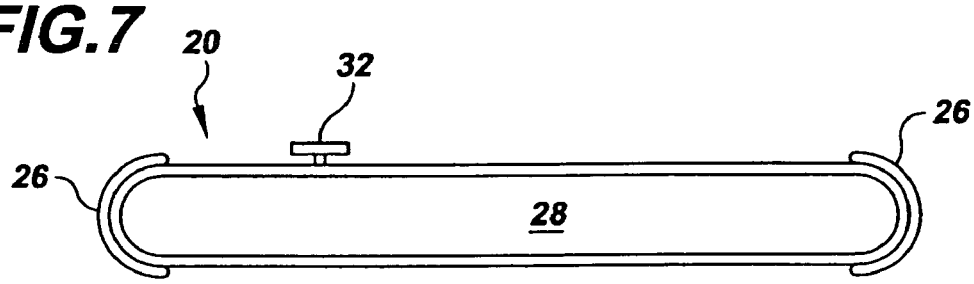
FIG. 7 is a bottom view of the patient's record holder and scheduler of FIG. 1.
Figure 8:
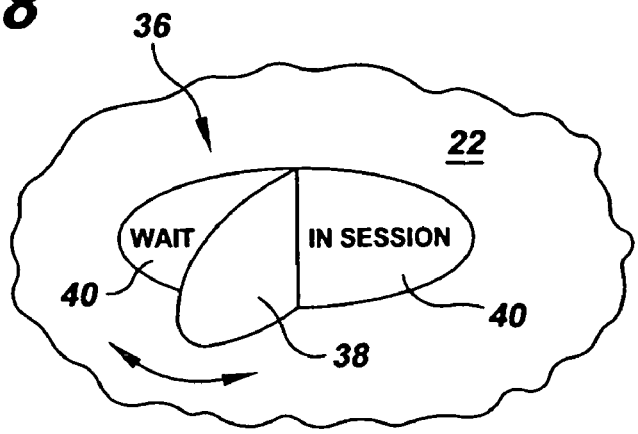
FIG. 8 is a close up view of the status indicator depicted in the patient's record holder and scheduler of FIG. 1.
Figure 9:
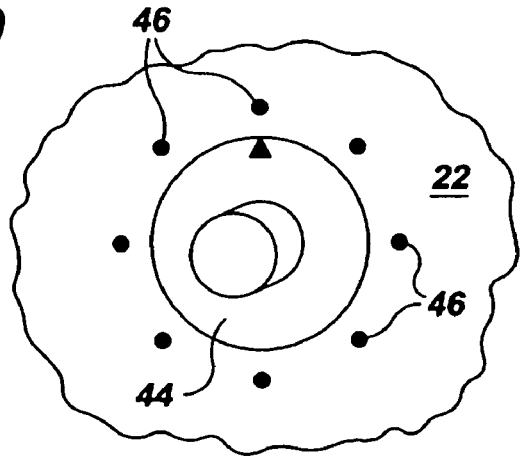
FIG. 9 is a close up of an alternate embodiment of the time indicator for the patient's record holder and scheduler of FIG. 1.

In an alternate embodiment, FIG. 9 depicts a close-up view of a dial-type indicator which may be utilized in place of the time and/or status indicated as depicted in FIGS. 1 and 2. In this alternate embodiment, a rotary knob 44 having an indicator thereon may be rotated to align with different indicia 46 indicating time or status associated with the patient.

In use, when a patient first enters a hospital or medical professional's office, that patient's records would be placed within the well of record holder 20. Once an initial treatment or visit time is scheduled, the time indicator would be moved to the scheduled time, and the status indicator would be positioned to indicate the current status of the patient with respect to the visit and/or treatment. The record holder and scheduler 20 may be positioned in a location near the patient, such as on the foot of the bed, or the wall or door of the examining room, and secured in place. As the medical professional attends to the patient, the status indicator may be changed to the then-current status of the patient's visit and/or treatment. At any time the patient's visit or treatment or visit time may be changed to indicate a different treatment or visit time. Once the patient is discharged or released from the visit or treatment, the record holder and scheduler may be reused for a different patient or other general use.

Thus the present invention provides a novel and useful record holder and scheduler that is readily accessed by the medical professional for the patient's record and at the same time provides an instant indication of the status of time of the patient's visit and treatment. While the preferred embodiment of the present invention is described for use in connection with medical records, it may be employed to hold and indicate schedule for any general office or industrial use.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of securing medical records and indicating schedule and status of a medical patient comprising:

providing a file container of sufficient size to hold a medical patient's tangible medical record, the file container having a base and front and rear faces, the file container being rigid, self supporting in an upright position on a horizontal surface, the file container including a schedule indicator positionable between different time markings to indicate visibly a time associated with the medical patient, the file container further including a condition indicator positionable between different indicia to indicate visibly a status of the medical patient;

placing a tangible medical record of the medical patient in the file container;

adjusting the schedule indicator to a scheduled time of the medical patient;

adjusting the condition indicator to a current status of the medical patient; and moving the file container to a location associated with the medical patient, and removably attaching the file container to a vertical surface at the location, to visibly indicate the scheduled time and status of the medical patient.

2. The method of claim 1 further including readjusting the condition indicator to change the current status of the person or thing.

3. The method of claim 1 further including re-adjusting the scheduling indicator to change the time associated with the person or thing.

* * * * *